US005267373A

United States Patent [19]

Chisek

[11] Patent Number: 5,267,373

[45] Date of Patent: Dec. 7, 1993

[54] CABLE TIE WITH STRAP TIP GUIDE RAMP

[75] Inventor: J. Clark Chisek, Homewood, Ill.

[73] Assignee: Panduit Corp., Tinley Park, Ill.

[21] Appl. No.: 969,498

[22] Filed: Oct. 30, 1992

[51] Int. Cl.[5] ..... B65D 63/14

[52] U.S. Cl. ..... 24/16 PB; 24/30.5 P

[58] Field of Search ..... 24/30.5 P, 17 AP, 16 R, 24/16 PB; 248/74.3

[56] References Cited

U.S. PATENT DOCUMENTS

| | | | |
|---|---|---|---|
| 3,537,146 | 11/1970 | Caveney | 24/16 |
| 3,761,999 | 10/1973 | Morgan | 24/16 |
| 3,872,547 | 3/1975 | Caveney et al. | 24/16 |
| 3,967,345 | 7/1976 | Sumimoto | 24/16 |
| 3,973,293 | 8/1976 | Noorily | 24/16 |
| 4,136,148 | 1/1979 | Joyce | 264/291 |
| 4,214,349 | 7/1980 | Munch | 24/16 |
| 4,413,380 | 11/1983 | Suzuki | 24/16 |
| 4,688,302 | 8/1987 | Caveney et al. | 24/16 |
| 4,735,387 | 4/1988 | Hirano et al. | 248/71 |
| 4,875,647 | 10/1989 | Takagi et al. | 248/74.3 |
| 4,955,913 | 9/1990 | Robinson | 606/228 |
| 4,978,091 | 12/1990 | Anderson et al. | 248/74.3 |

*Primary Examiner*—James R. Brittain

*Attorney, Agent, or Firm*—Charles R. Wentzel; Mark D. Hilliard; Robert A. McCann

[57] ABSTRACT

A cable tie with a strap guide ramp includes a strap, a locking head secured to the first end of the strap, a plurality of walls on the locking head forming a strap positioning channel, a pawl positioned within the channel and pivotally mounted to the locking head and strap guide ramp contiguous to the pawl for directing the tip of the strap during initial insertion of the strap into the channel away from the pawl and towards the strap positioning channel. The strap guide ramp prevents plastic deformation of the pawl during insertion of the tip of the strap when the tip of the strap is inadvertently directed against the pawl which enhances the reliability of the cable tie and is especially useful for cable tie formed of less resilient materials.

4 Claims, 3 Drawing Sheets

CABLE TIE WITH STRAP TIP GUIDE RAMP

TECHNICAL FIELD

The present invention relates generally to cable tie fasteners and relates specifically to one piece plastic cable tie fasteners having a channel formed through a strap locking head that encloses a pivotal strap locking pawl.

BACKGROUND ART

One piece plastic cable ties having strap locking pawls formed within a strap locking channel of the head of the cable tie, with the pawl pivotally mounted to the head of the cable tie by a discrete hinge section are well known in the art. Reference may be made to U.S. Pat. No. 3,872,547 owned by common assignee Panduit Corp.

This type of cable tie includes a stop or chin member that is formed on a portion of the pawl adjacent the entrance of the strap channel of the cable tie, with the stop member formed forwardly of the hinge of the cable tie. The stop member is adapted to move toward and into abutment with an inner wall of the strap positioning channel to support the pawl against excess tension induced rotation when the strap is tensioned within the head of the cable tie.

A problem arises when the tip of a cable tie strap is inadvertently inserted into engagement with the stop member of the pawl, rotating the pawl away from the strap positioning channel, which can damage the pawl by plastically deforming the pawl such that it does not spring back to engage the strap, a condition known in the art as pawl-set-back. Although typically not a practical problem in cable ties formed of highly resilient materials such as nylon, a significant number of failures are encountered when the cable ties are formed of more easily deformed plastic materials such as E. I. DuPont's TEFZEL ® and Ausimont, Inc.'s HALAR ®. A solution to this problem is made more difficult since modification of the construction of the shape and manner of attachment of the pawl to the cable tie head affects the amount of force needed to insert the strap of the cable tie into the locking head of the cable tie, which is desirably minimized, and affects the loop tensile strength of the cable tie, which is desirably maximized.

Thus there is need for improvement in the art.

SUMMARY OF THE INVENTION

It is the object of the present invention to provide an improved one piece plastic cable tie that is more reliable.

It is another object of the present invention to provide an improved one piece plastic cable tie that can be formed of a greater number of materials.

It is an additional object of the present invention to provide an improved one piece plastic cable tie that is not susceptible to plastic deformation of the cable tie pawl during insertion of the cable tie strap.

In general a cable tie with strap guide ramp includes a strap including a first end and a tip, a locking head secured to the first end of the strap, a plurality of walls on the locking head forming a strap positioning channel, a strap locking pawl positioned within the channel and pivotally mounted to the locking head and strap guide ramp means contiguous to the pawl for directing the tip of the strap during initial insertion of the strap into the channel away from the pawl and towards the strap positioning channel.

DESCRIPTION OF THE PREFERRED EMBODIMENT

Figure 3:
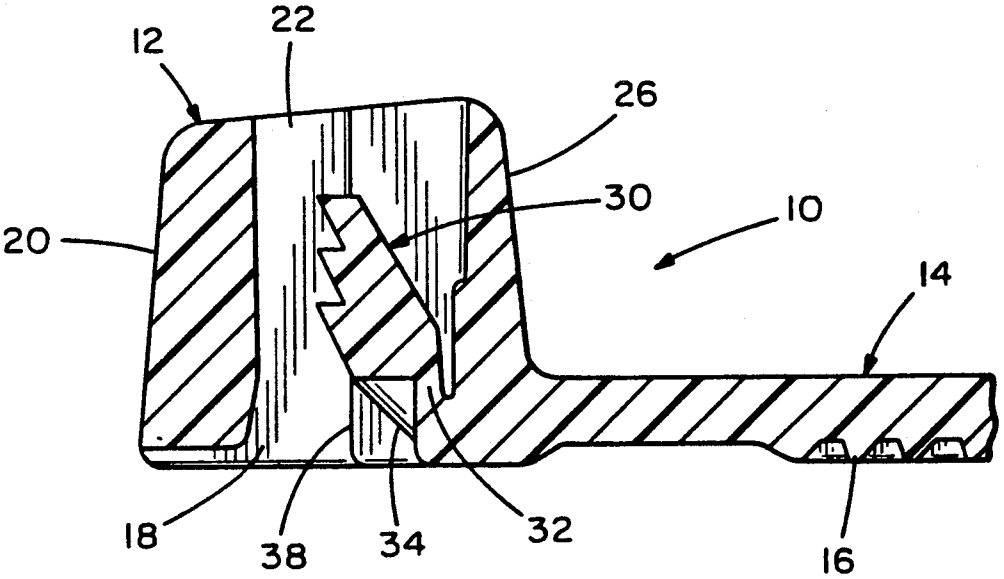
FIG. 3 is a sectional view taken along line 3—3 of FIG. 2.
Figure 1:
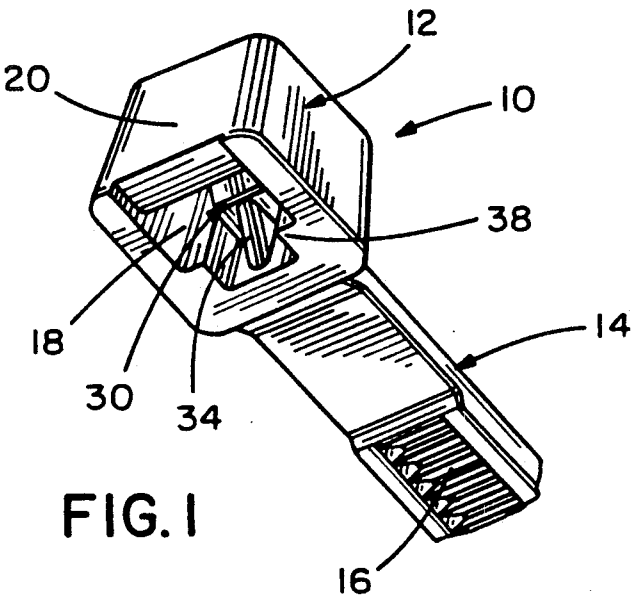
FIG. 1 is a fragmentary perspective view of the head and a portion of the strap of a cable tie embodying the concept of the invention.
Figure 2:
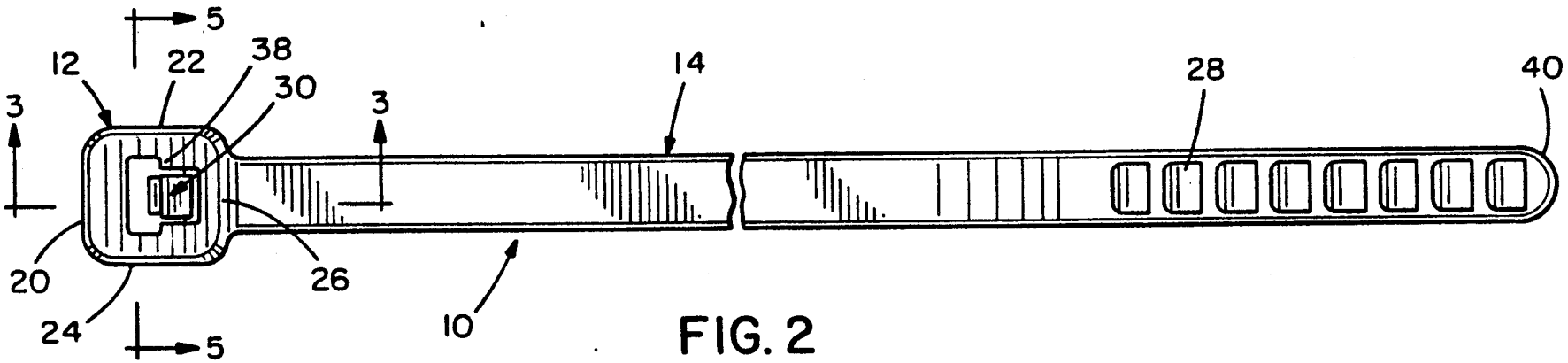
FIG. 2 is a top view of the cable tie of FIG. 1.

A cable tie embodying the concept of the present invention is designated generally by the numeral 10 in the accompanying drawings. Cable tie 10 preferably is integrally molded of thermoplastic. Although cable tie 10 can be integrally molded of a range of thermoplastic materials known in the art, most commonly including various types of nylon, the design of cable tie 10 is especially useful for specialized less resilient materials that are more easily plastically deformed such as E. I. DuPont's TEFZEL ® and Ausimont, Inc.'s HALAR ®. Cable tie 10 includes a head 12 and a strap 14 having a plurality of teeth 16. A strap channel 18 is defined in head 12 by an end wall 20, a first side wall 22, a second side wall 24 and an inner wall 26. A plurality of ridges 28 are formed on the top planar surface of tie 10, along the distal end of strap 14 to facilitate grasping strap 14. A pawl 30 is formed in strap channel 18 with a discrete hinge section 32 pivotally attaching pawl 30 to inner wall 26.

Figure 4:
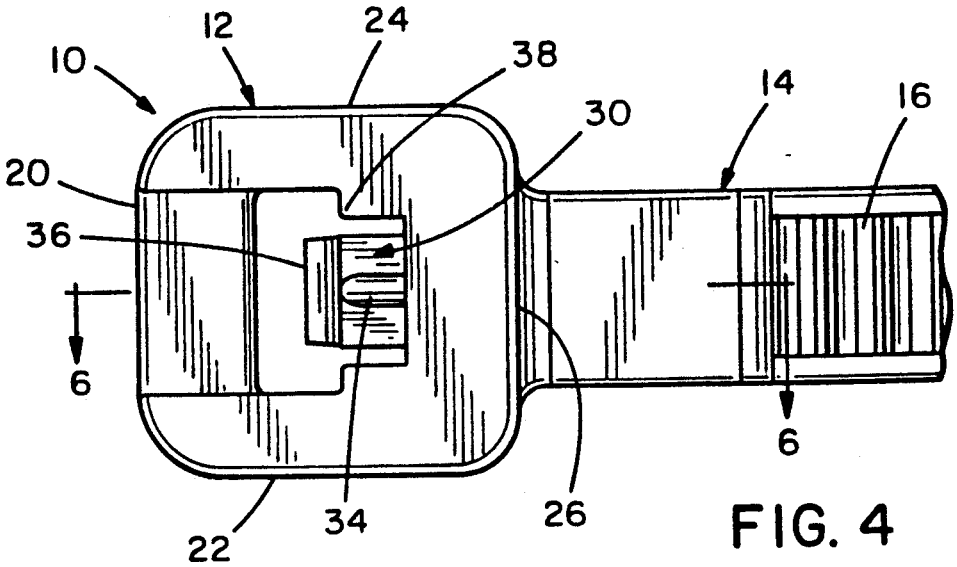
FIG. 4 is a fragmentary bottom view of the cable tie of FIG. 2.
Figure 5:
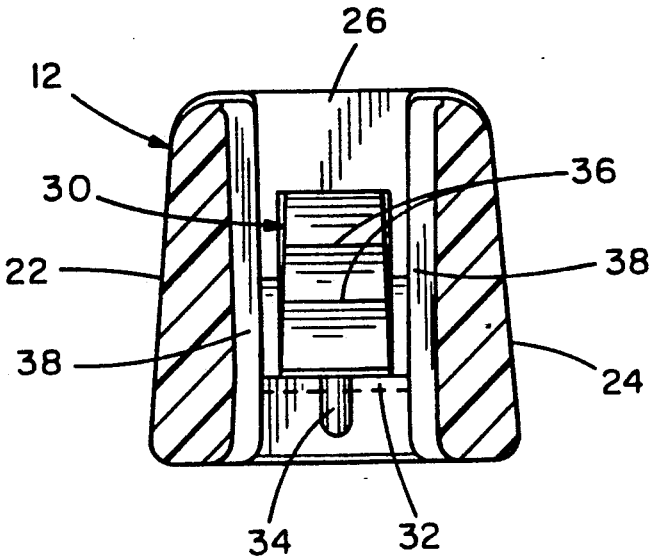
FIG. 5 is a sectional view taken along line 5—5 of FIG. 2.

A strap guide ramp 34 is contiguous to and formed integrally with pawl 30, hinge section 32 and inner wall 26, tapering from the entrance of strap channel 18 and adjacent inner wall 26, towards end wall 20 and to an inner edge of pawl 30 such that a continuous inclined ramp is formed. Strap guide ramp 34, as seen in FIGS. 4 and 5, is approximately one third the width of pawl and is formed on the pawl 30 adjacent the strap entrance of strap channel 18. The shape and width of strap guide ramp does not significantly increase the insertion force required to insert a strap 14 past pawl 30 while providing a ramp and pawl hinge combination that provides adequate loop tensile strength to cable tie 10.

Teeth 36 are formed on pawl 30, see FIGS. 4–5. Strap rails 38 are formed on either side of pawl 30 extending through strap channel 18 to position strap 14 outwardly of a portion of pawl 30. Teeth 36 of pawl 30 project into strap channel 18 past strap rails 38 to engage teeth 16 of strap 14.

Figure 6:
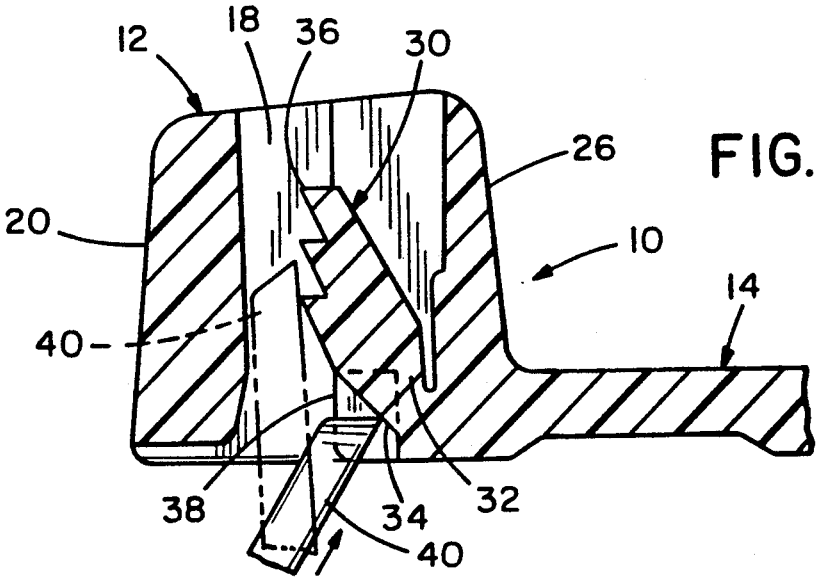
FIG. 6 is a sectional view taken along line 6—6 of FIG. 4 showing a tip of the cable tie engaging a strap guide ramp that directs the tip of the cable tie into a strap positioning channel of the cable tie.
Figure 7:
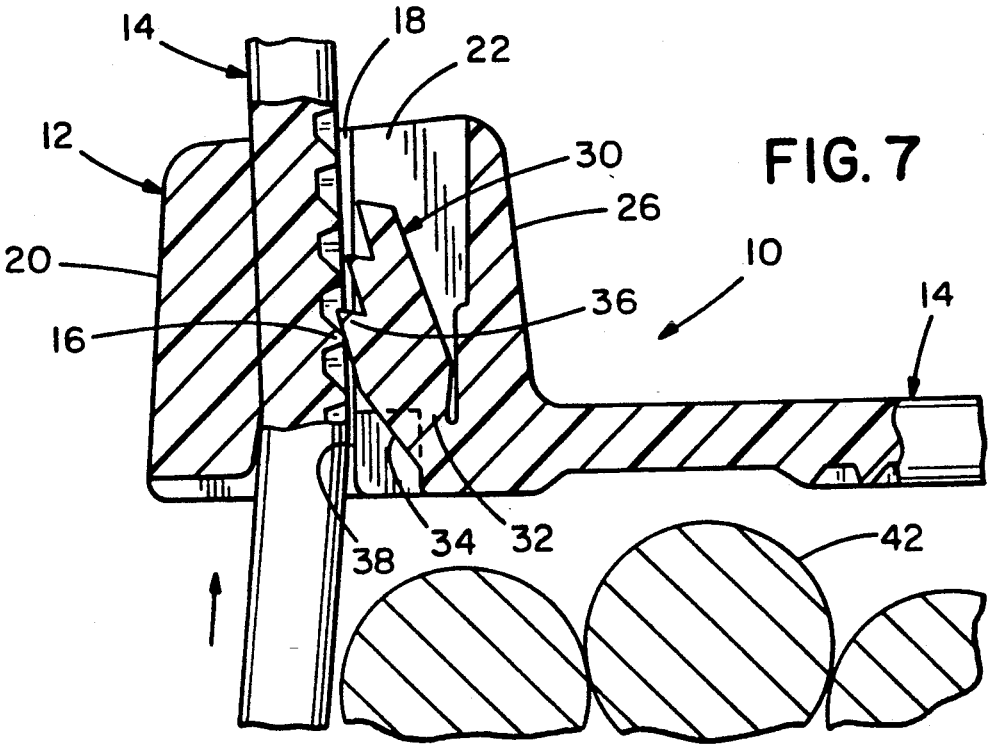
FIG. 7 is a fragmentary view of the cable tie of FIG. 1, shown partially in section and disposed around a plurality of wires, as the strap of the cable tie is inserted through the head of the cable tie.
Figure 8:
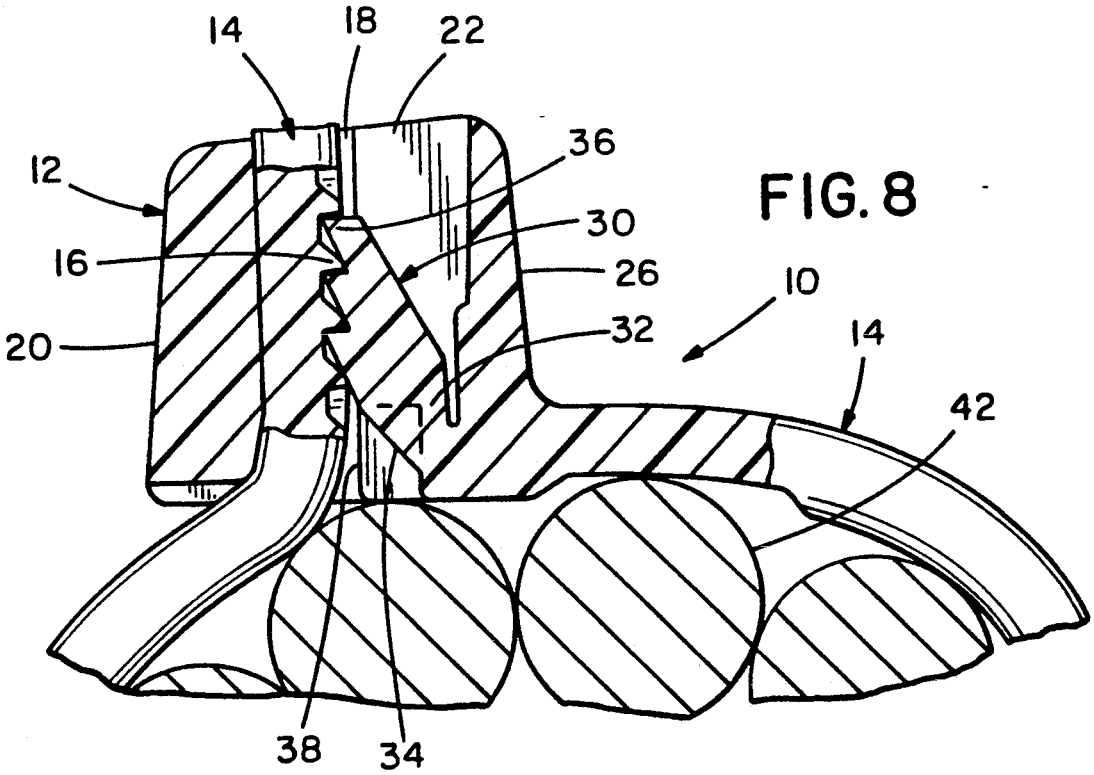
FIG. 8 is a view similar to FIG. 7 showing the cable tie being tensioned against the of wires.

As best seen in FIGS. 6–8, a strap tip 40 inserted in the direction of the arrows and inadvertently directed against guide ramp 34 is continuously directed towards strap channel 18, away from pawl 30, into the position shown in phantom in FIG. 6, which prevents undesirable over-rotation of pawl 30 and ensures secure application of cable tie 10 around wires 42 as shown in FIG. 8.

While the particular preferred embodiment of the present invention has been shown and described, it will be obvious to those skilled in the art that changes and modifications may be made without departing from the teachings of the invention.

I claim:

1. A cable tie, comprising:

a strap including a first end and a tip;

a locking head secured to the first end of the strap;

a plurality of walls on the locking head forming a strap positioning channel;

a strap locking pawl positioned within the channel and pivotally mounted to the locking head; and strap guide ramp for directing the tip of the strap during initial insertion of the strap into the channel away from the pawl and towards the strap positioning channel, wherein the ramp is disposed on a forward surface of the pawl adjacent a strap entrance portion of the strap positioning channel and is of a lesser width than the pawl.

2. A cable tie as set forth in claim 1, wherein the ramp is approximately one third of the width of the pawl.

3. A cable tie as set forth in claim 2, including a hinge section connecting the pawl to the head of the cable tie and wherein the ramp is integrally formed with an adjacent one of the walls of the strap positioning channel, the hinge section and the pawl and wherein the ramp tapers from the adjacent wall towards an opposite one of the walls of the locking head and to an inner edge of pawl such that a continuous inclined ramp is formed.

4. A cable tie as set forth in claim 2, wherein the ramp is integrally formed with an adjacent one of the walls of the strap positioning channel and the pawl and wherein the ramp tapers from the adjacent wall towards an opposite one of the walls of the locking head and to an inner edge of pawl such that a continuous inclined ramp is formed.

* * * * *